US012102935B1

(12) United States Patent
Ruggiero et al.

(10) Patent No.: US 12,102,935 B1
(45) **Date of Patent: *Oct. 1, 2024**

(54) BUBBLE BLOWER

(71) Applicant: Sunny Days Entertainment, LLC, Simpsonville, SC (US)

(72) Inventors: Jim Ruggiero, Simpsonville, SC (US); Ka Shun Lo, Tsuen an (HK)

( * ) Notice: Subject to any disclaimer, the term of this patent is extended or adjusted under 35 U.S.C. 154(b) by 155 days.

This patent is subject to a terminal disclaimer.

(21) Appl. No.: 17/833,319

(22) Filed: Jun. 6, 2022

Related U.S. Application Data

(60) Provisional application No. 63/196,829, filed on Jun. 4, 2021.

(51) Int. Cl.
*A63H 33/28* (2006.01)
*A63H 29/22* (2006.01)

(52) U.S. Cl.
CPC ..... *A63H 33/28* (2013.01); *A63H 29/22* (2013.01)

(58) Field of Classification Search
CPC ..... A63H 33/28
USPC ..... 446/15, 16
See application file for complete search history.

(56) References Cited

U.S. PATENT DOCUMENTS 3,879,885 A * 4/1975 Fabricant ..... A47G 21/182 446/202
6,820,662 B2 * 11/2004 Crawford ..... A63H 33/28 141/366
8,272,915 B2 * 9/2012 Thai ..... A63H 33/28 446/16
8,272,916 B2 * 9/2012 Thai ..... A63H 33/28 446/16
8,636,557 B2 1/2014 Lo
9,339,737 B2 5/2016 Chan
9,441,831 B2 * 9/2016 Fossen ..... F21V 33/006
9,757,661 B2 9/2017 Chan
9,878,262 B2 1/2018 Chan
9,884,262 B2 * 2/2018 Huey ..... A63H 33/28
10,363,492 B1 * 7/2019 Thai ..... A63H 33/28
10,702,788 B2 * 7/2020 Thai ..... A63H 33/28
10,807,015 B2 10/2020 Chan
10,814,243 B2 * 10/2020 Clayton ..... A63H 33/28
(Continued)

FOREIGN PATENT DOCUMENTS

CN 2930817 Y 8/2007
CN 201055703 Y 5/2008
(Continued)

*Primary Examiner* — Joseph B Baldori
(74) *Attorney, Agent, or Firm* — Waddey Acheson; Ira C. Waddey, Jr.

(57) ABSTRACT

A bubble blowing apparatus comprising a main body, a plurality of legs connecting the main body to a base, a motor, a fan operably coupled to the motor to blow an upward stream of air, a liquid fountain unit operably coupled to the motor to blow a bubble solution upward, a gear shaft operably coupled to the motor to rotate about a rotational axis, and a plurality of bubble wands rigidly affixed to an upper portion of the gear shaft. Further, the gear shaft is configured to continuously rotate about the rotational axis, such that each of the plurality of bubble wands repetitively cycle between the two positions of (1) passing over the liquid fountain unit so as to amass upwardly blown bubble solution, and (2) passing over the fan such that the amassed bubble solution contacts the upwardly blown air and forms a bubble.

20 Claims, 13 Drawing Sheets

(56) References Cited

U.S. PATENT DOCUMENTS

| | | | | |
|---|---|---|---|---|
| 11,278,823 | B2 * | 3/2022 | Clayton | A63H 29/22 |
| 11,446,584 | B2 * | 9/2022 | Yang | A63H 33/28 |
| 11,458,411 | B1 * | 10/2022 | Thai | A63H 33/26 |
| 11,772,004 | B2 * | 10/2023 | Ruggiero | A63H 29/22<br>446/15 |
| 2003/0199221 | A1 * | 10/2003 | Thai | A63H 33/28<br>446/15 |
| 2004/0142626 | A1 * | 7/2004 | Choi | A63H 33/28<br>446/15 |
| 2023/0158419 | A1 * | 5/2023 | Ruggiero | A63H 33/28<br>446/15 |

FOREIGN PATENT DOCUMENTS

| | | | |
|---|---|---|---|
| CN | 203001985 | U | 6/2013 |
| CN | 104922917 | A | 9/2015 |
| CN | 108499138 | | 9/2018 |
| EP | 2921213 | A1 | 9/2015 |

* cited by examiner

BUBBLE BLOWER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application is a non-provisional of U.S. Patent Application No. 63/196,829 filed Jun. 4, 2021 entitled VERTICAL BUBBLE BLOWER, which is hereby incorporated by reference in its entireties.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to a toy and more particularly a toy bubble blower machine.

Various types of bubble blower machines are known in the art. Conventional toy bubble blowers typically include, at a minimum, a source of bubble-forming liquid and some type of ring shaped dipper to pick up the bubble-forming liquid. Currently existing toy bubble blowers take all kinds of shapes and sizes. Some of these include bubble "blasters" or "shooters" that take the shape of a gun and typically rely on a battery powered or mechanically activated trigger-pull mechanism to form and shoot the bubbles. Others are push/pull bubble blowers that rely on the physical application of force to activate the creation of bubbles, such as "bubble lawn-mowers" that create bubbles when pushed by a child. Others take the shape of simple wands that can be manually dipped into a bubble solution and blown by the user to create bubbles.

However, each of these types of blowers come with their own variety of problems. For example, the use of simple wands results in the unnecessary and undesirable loss of bubble solution when excess bubble solution collected on the wand drips off the wand onto the ground or a user's body when the user is blowing air into the wand to form bubbles. Also, breath-actuated bubble devices such as wands can result in users getting tired or light headed from exhaling too much air in too short a time. Bubble guns require users to squeeze a trigger for bubble creation and blasting. Because children run around using such bubble guns to shoot at their friends, large amounts of bubble solution often leak from the gun and create a mess. Also, constant trigger activation is required of the user in order to produce a steady reliable stream of bubbles.

On the other hand, mechanically activated blowers are not ideal due to their inability to create a relatively continuous stream of bubbles. Mechanically activated bubble blowers, such as push/pull "lawnmower"-type blowers and wind-up blowers, typically require a large degree of effort to maintain a steady output of fully formed bubbles. This is because mechanically activated blowers must be physically moved with a sufficient degree of speed and force in order to effectively operate the blower's internal bubble making and blowing mechanisms. Failure to move the mechanically activated blowers with sufficient force will result in the blower's failure to produce bubbles. Requiring such levels of effort from younger users can often lead to the child becoming physically exhausted and losing their motivation to make bubbles. Furthermore, currently existing bubble blowers become messy when trying to add bubble solution, and can be difficult to use and expensive to manufacture.

What is needed then are improvements to toy bubble blower machines that address these and other problems.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a bubble blower apparatus. In an embodiment, the bubble blower apparatus can comprise a main body, a base that is connected to the main body by a plurality of legs, a motor, a fan, a liquid fountain unit configured to hold a bubble solution, a gear shaft, and a plurality of bubble wands rigidly affixed to an upper portion of the gear shaft. In an exemplary embodiment, the fan can be operably coupled to the motor to blow an upward stream of air, the liquid fountain unit can be operably coupled to the motor to blow the bubble solution in a generally upward direction, and the gear shaft can be operably coupled to the motor to rotate about a rotational axis. In these embodiments, when the gear shaft is rotating about the rotational axis, each of the plurality of bubble wands are repetitively cycling between (1) passing over the liquid fountain unit so as to amass upwardly blown bubble solution, and (2) passing over the fan such that the amassed bubble solution contacts the upwardly blown air and forms a bubble. In this manner, a continuous stream of fully formed bubbles are created.

Another aspect of the disclosure is a method for blowing bubbles. Such a method may comprise providing a bubble blower apparatus, providing a bubble solution, activating the motor of the bubble blower apparatus, and continuously rotating the gear shaft about the rotational axis, such that each of the plurality of bubble wands repetitively cycle between (1) passing over the liquid fountain unit so as to amass upwardly blown bubble solution, and (2) passing over the fan such that the amassed bubble solution contacts the upwardly blown air and forms a bubble.

Numerous other objects, advantages and features of the present disclosure will be readily apparent to those of skill in the art upon a review of the following drawings and description of a preferred embodiment.

DETAILED DESCRIPTION

Figure 1:
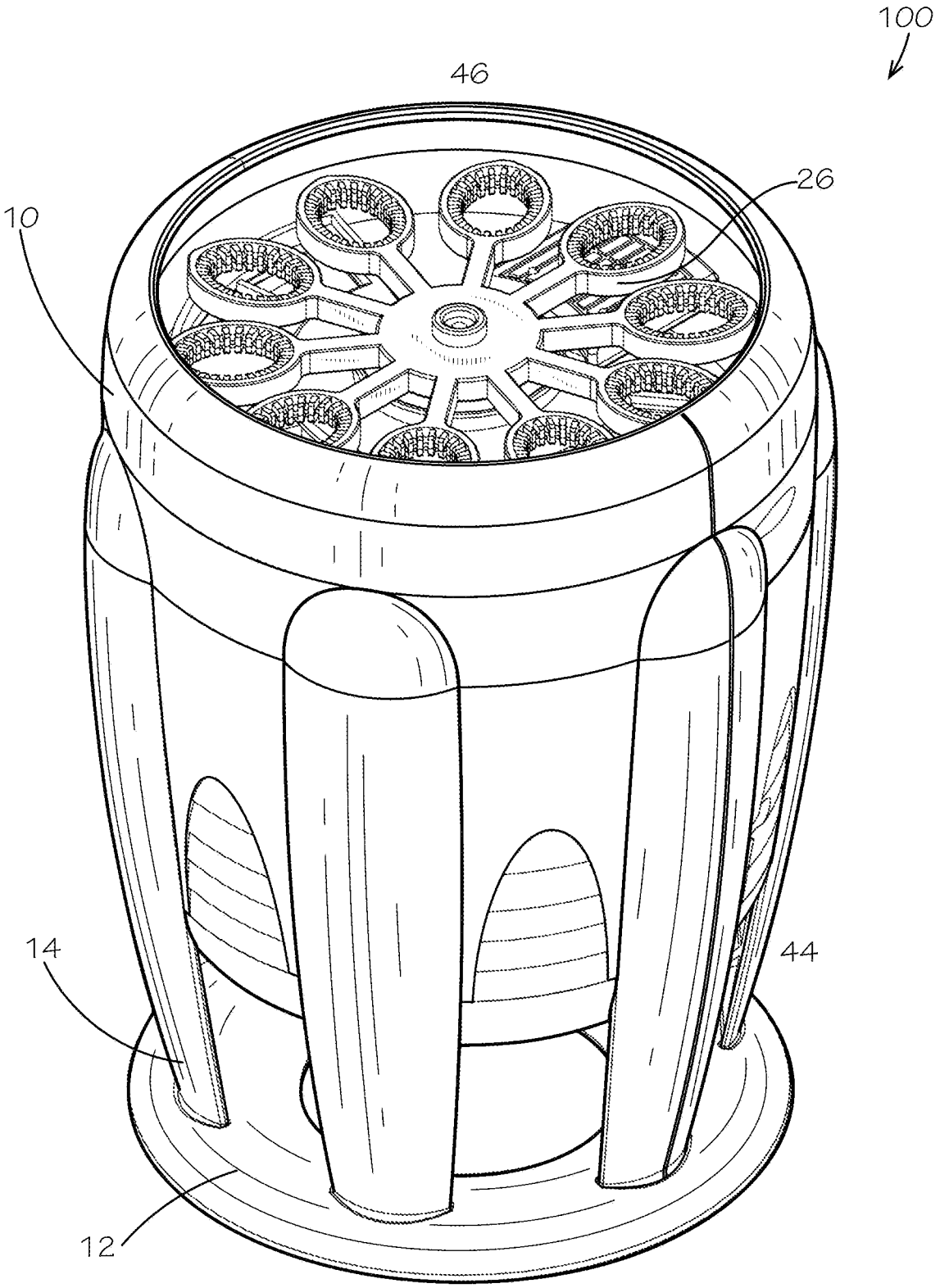
FIG. 1 is a perspective view of an embodiment of a bubble blowing machine.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

Figure 2:
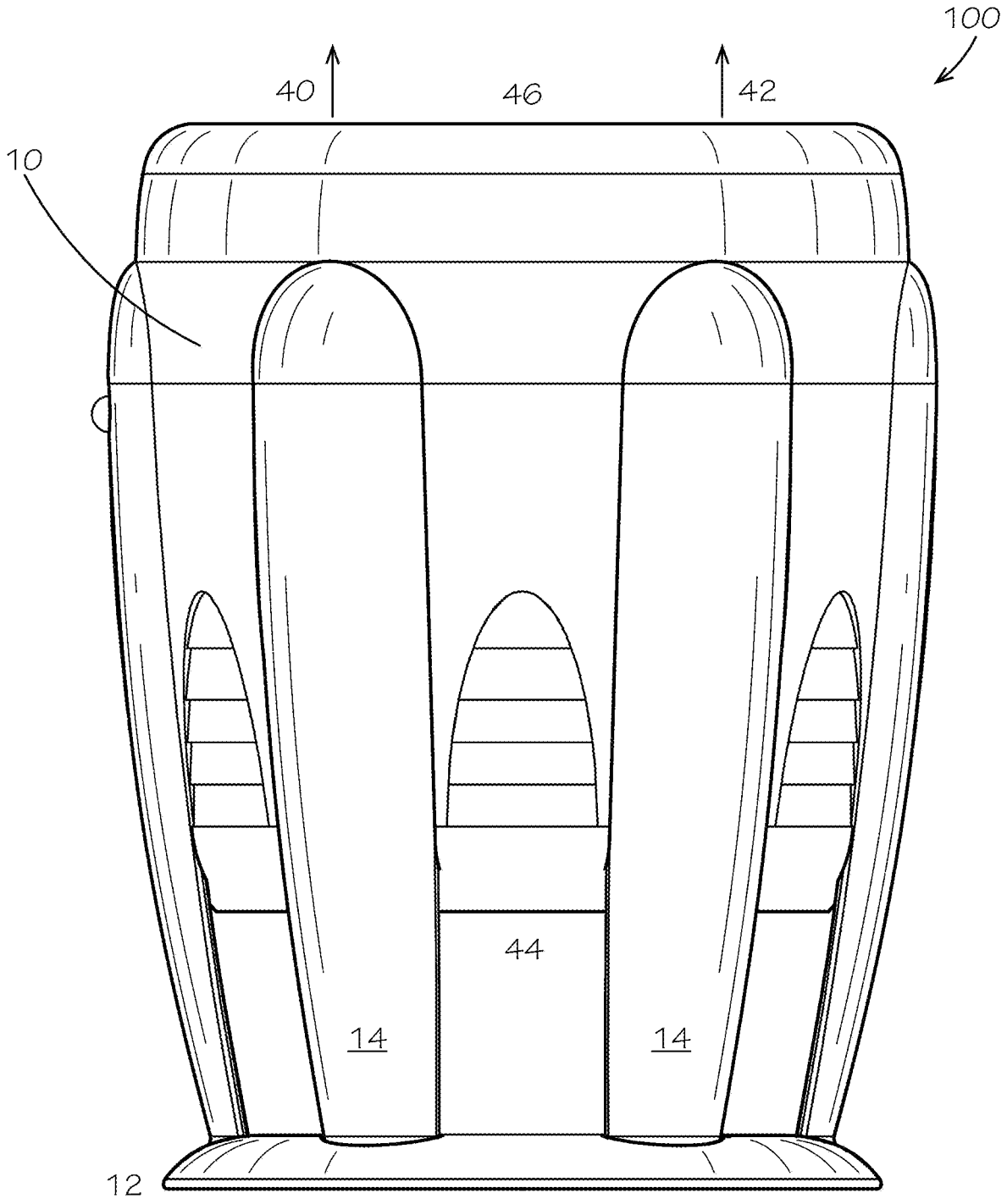
FIG. 2 is a front view of an embodiment of a bubble blowing machine resting on a flat surface.

Referring now to the drawings, FIGS. 1 and 2 illustrate an embodiment of a bubble blowing apparatus 100 including a main body 10 having a bottom side 44 and a top side 46. Main body 10 in some embodiments includes a plastic molded main body housing. In various embodiments, main body 10 is manufactured via rotational molding, injection molding, 3D printing, or any other suitable methods of manufacture. The bottom side 44 of the main body 10 may be connected to a base 12 by a plurality of legs 14. Base 12 enables bubble blowing apparatus 100 to sit upright on a flat resting surface such as a table or the ground, as is depicted in FIG. 2. Furthermore, main body 10 of apparatus 100 houses a plurality of bubble wand members 26. The bubble wands 26 are at least partially responsible for the creation of bubbles.

Figure 3:
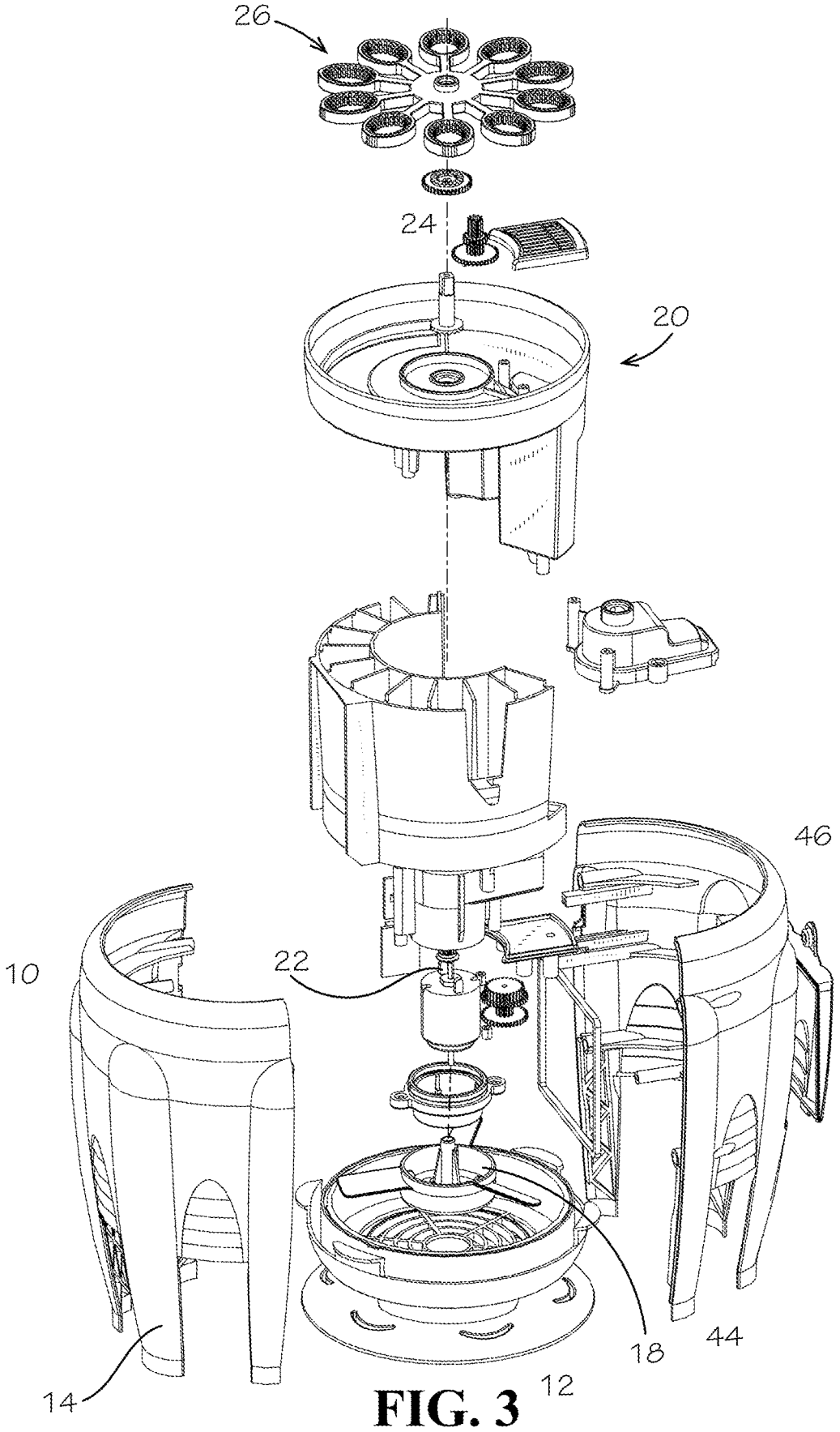
FIG. 3 is an exploded view of an embodiment of a bubble blowing machine.

Referring now to FIG. 3, in an exemplary embodiment, the bubble blower apparatus 100 further includes a motor 16, a fan 18, a liquid fountain unit 20 and a gear shaft 22, each of which are housed inside of the main body 10. The motor 16 may be a battery powered electrical motor or any other suitable motor. Fan 18 is the bottom-most internal component of bubble blower apparatus 100, generally located at the main body bottom side 44. Fan 18 is operably coupled to the motor 16 to rotate about a rotational axis 24 and produce an upward stream of air 40 that exits from the main body top side 46. The gear shaft 22 is internally located in a central portion of apparatus 100 and runs throughout main body 10 from the main body bottom side 44 to the main body top side 46. Gear shaft 22 is operably coupled to motor 16 to rotate about a rotational axis 24. In this exemplary embodiment, the plurality of bubble wands 26 are rigidly affixed to a top portion of the gear shaft 22 and comprise the top-most located internal component of bubble blower apparatus 100, generally found closest to the main body top side 46. Because of their rigid affixation to gear shaft 22, bubble wands 26 are also configured to rotate about rotational axis 24. Liquid fountain unit 20 is located directly beneath the plurality of bubble wands 26, and operably coupled to motor 16 to blow a bubble solution in a generally upward direction 42.

Figure 8:
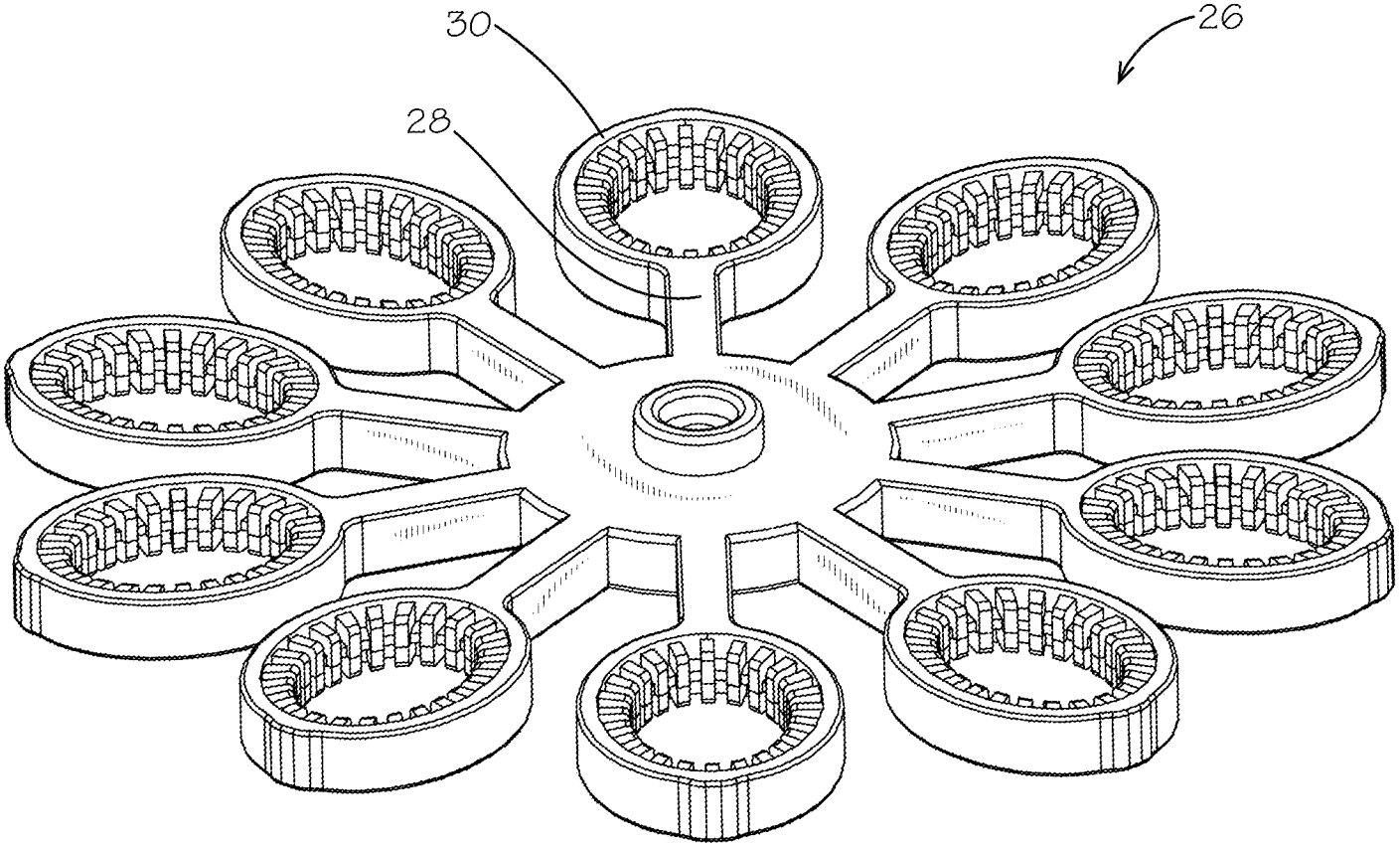
FIG. 8 is an isometric view of an embodiment of a bubble wand member.

As shown in FIG. 8, each of the plurality of bubble wands 26 comprise an extension member 28 and a hoop member 30. In some embodiments, hoop member 30 may be shaped as a circle, oval, or as any other shape that is conducive to the accumulation and retention of a bubble solution. Further, hoop member 30 may include a plurality of ridges shaped thereon, to further aid in bubble solution accumulation and retention. As can be seen in FIGS. 1 and 3-8, hoop member 30 is located at a distal end of the extension member 28, while the proximal end of extension member 28 is that which is rigidly affixed to the gear shaft 22. Because of its rigid affixation to gear shaft 22, the extension member 28 and the hoop member 30 of bubble wand 26 remain at a constant height at all times, never raising or lowering while in rotation about the rotational axis 24. Further, extension member 28 is connected to gear shaft 22 at an angle that is perpendicular to the rotational axis 24 in some embodiments. In some other embodiments, each of the plurality of bubble wands 26 may be integrally formed as a single "bubble wand unit" 26 that comprises a plurality of extension members 28 and hoop members 30.

Figure 4:
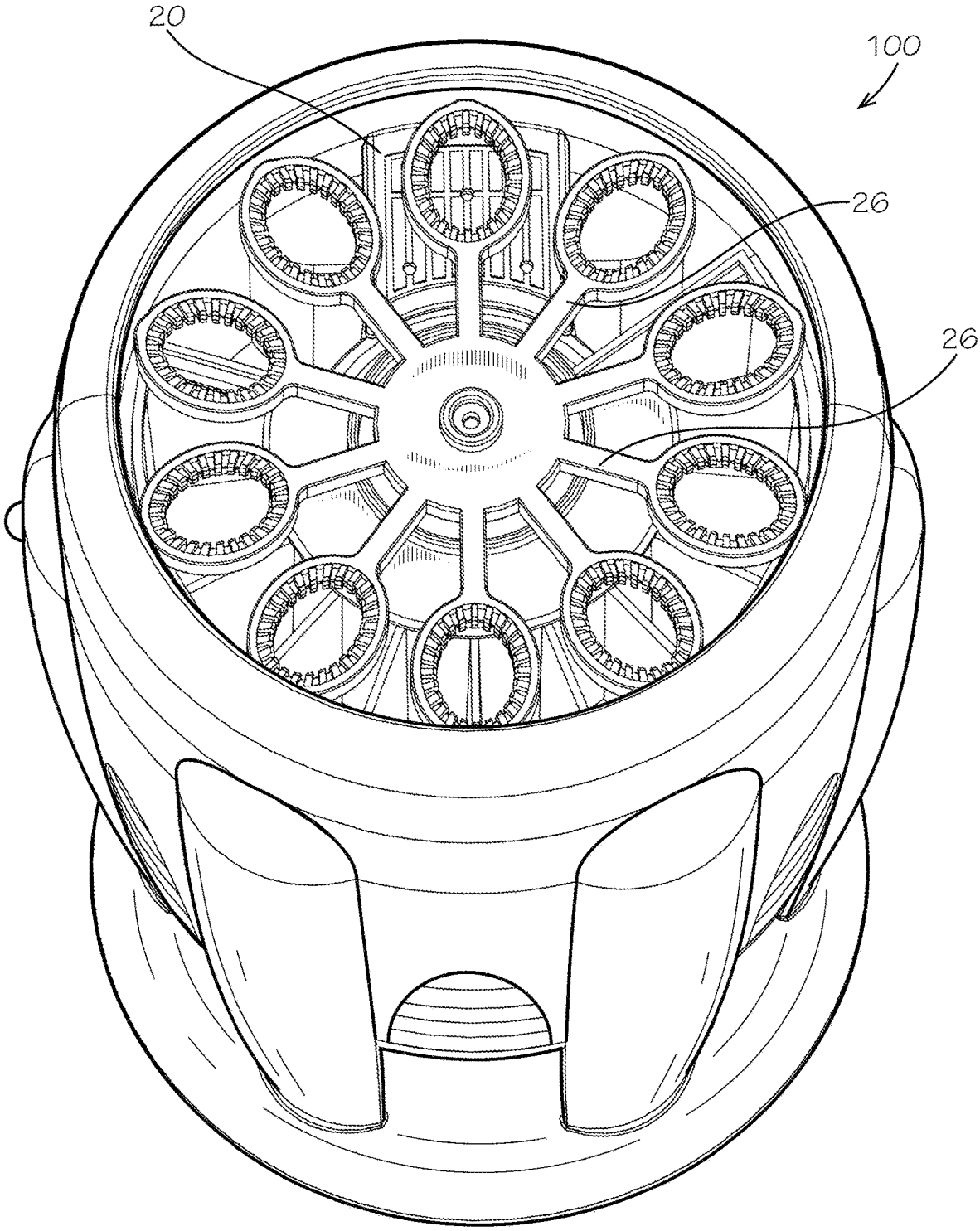
FIG. 4 is a perspective view of an embodiment of a bubble blowing machine having a single liquid fountain bubbler.
Figure 5:
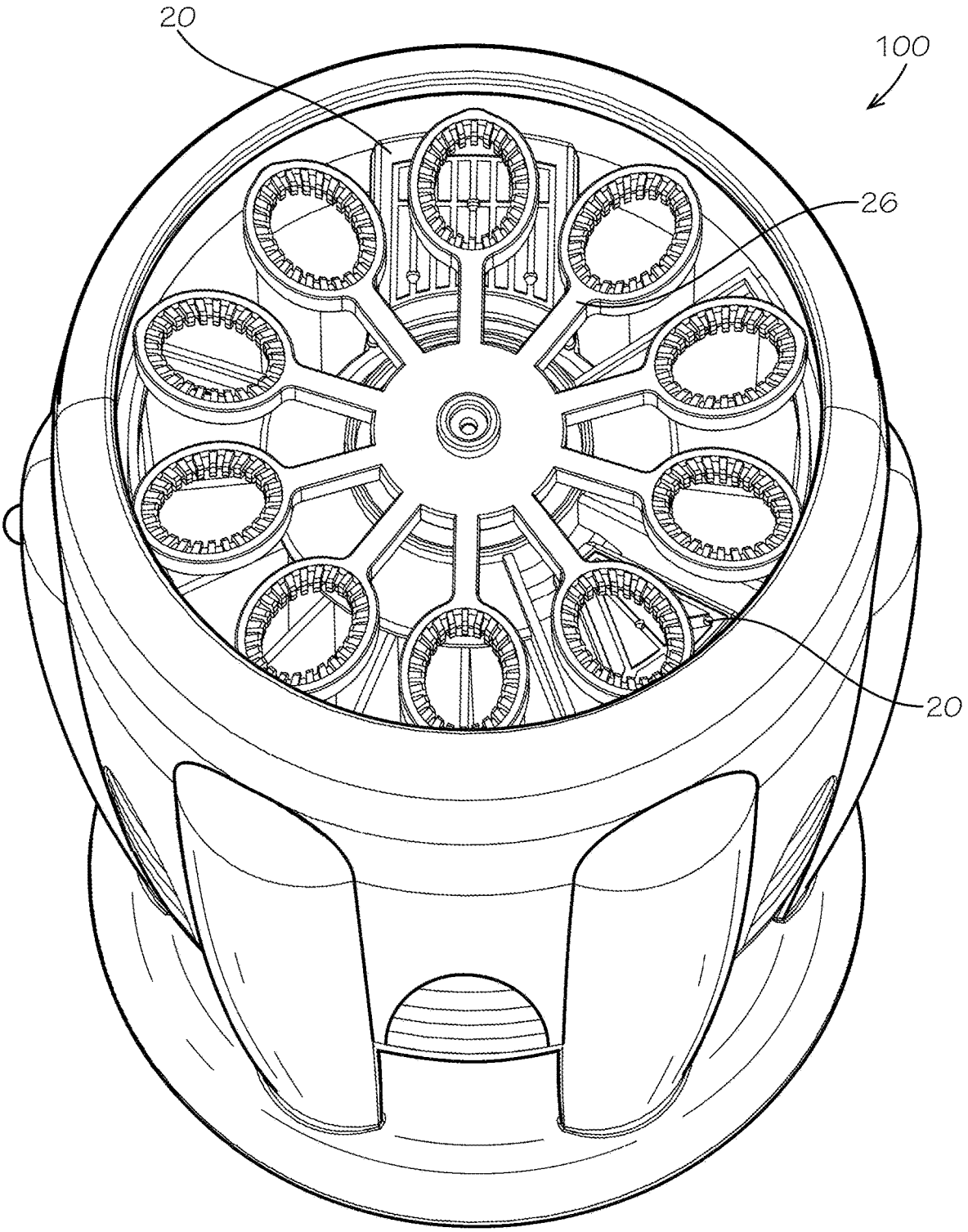
FIG. 5 is a perspective view of an embodiment of a bubble blowing machine having a plurality of liquid fountain bubblers.
Figure 6:
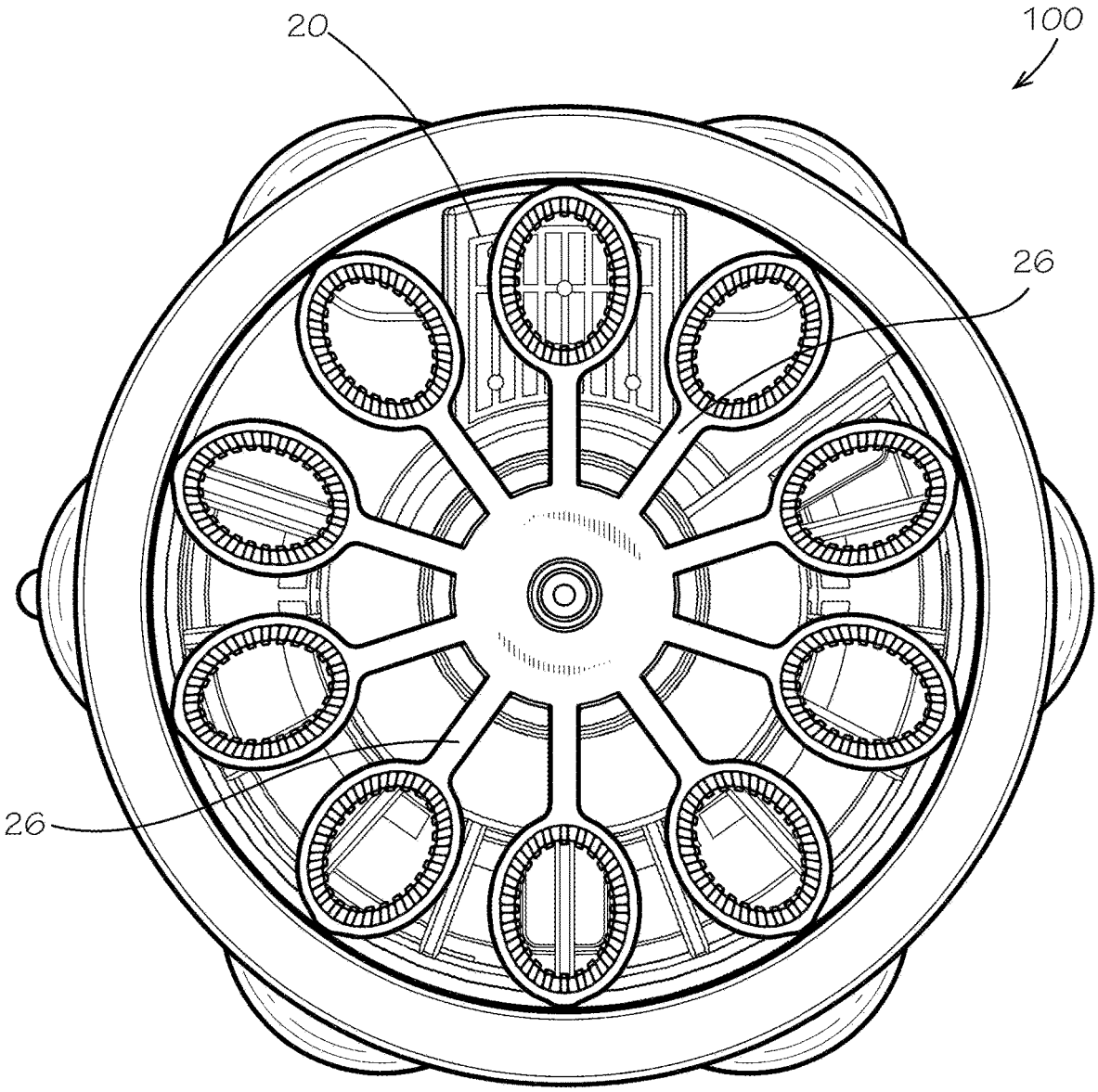
FIG. 6 is a top view of an embodiment of a bubble blowing machine having a single liquid fountain bubbler.
Figure 7:
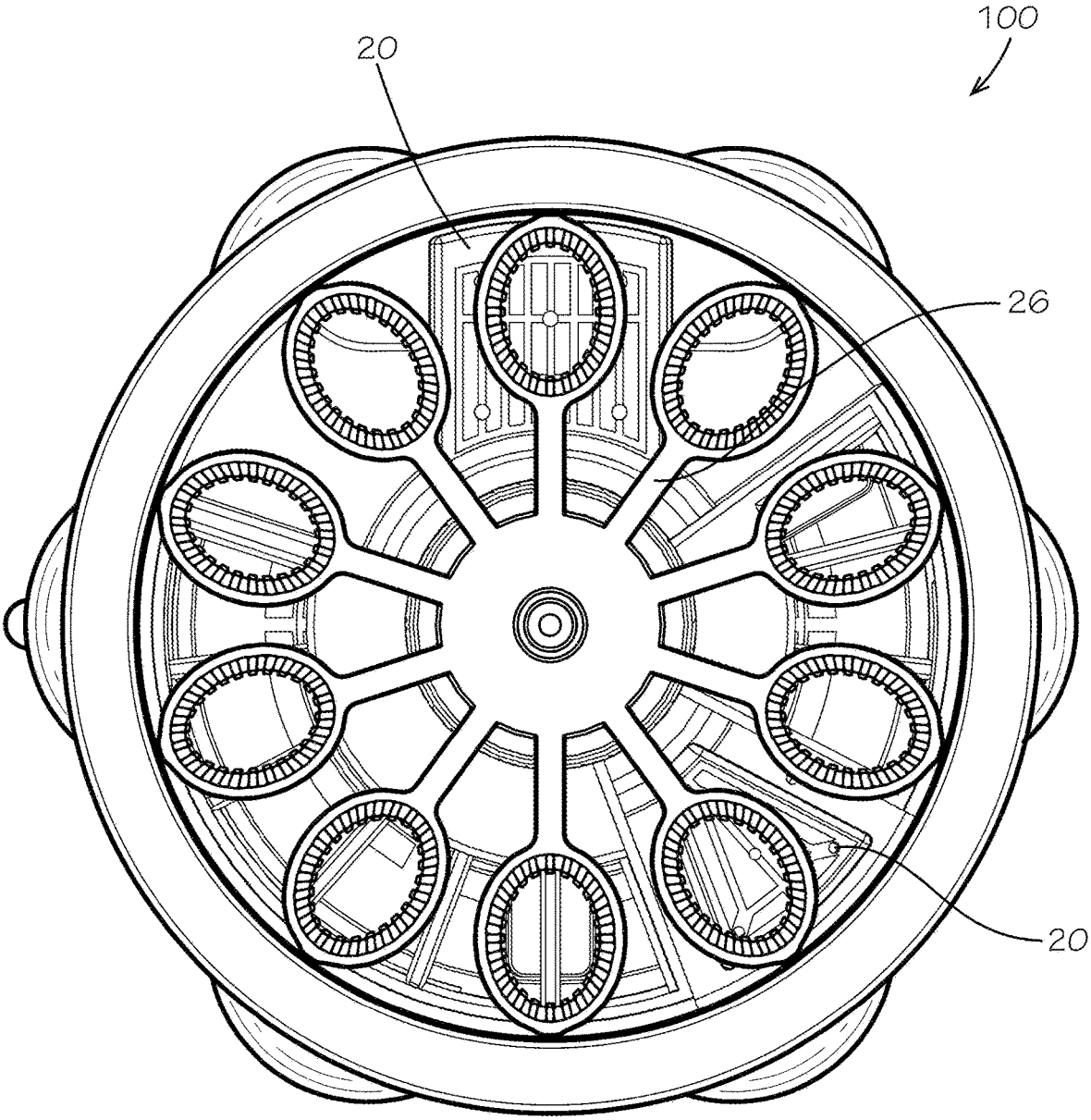
FIG. 7 is a top view of an embodiment of a bubble blowing machine having two liquid fountain bubblers.
Figure 9:
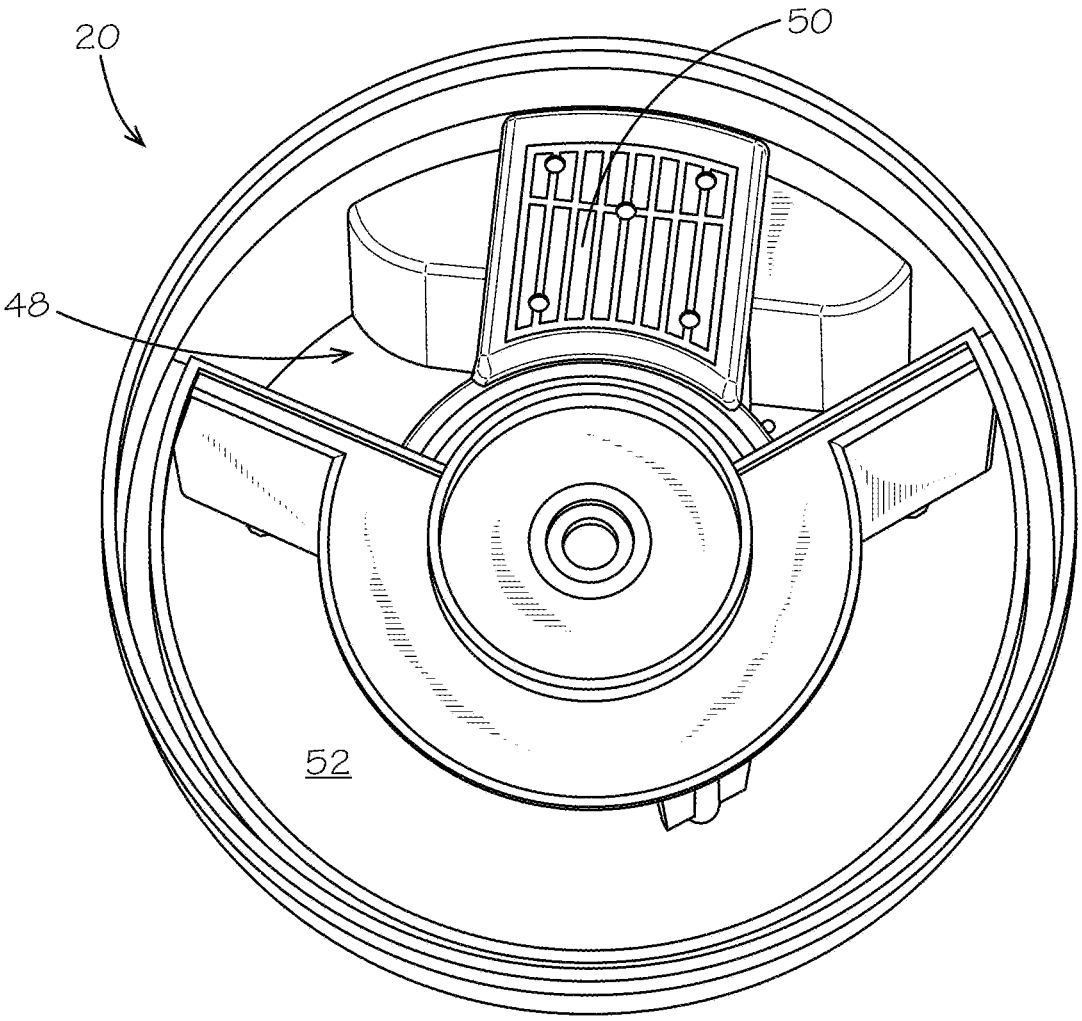
FIG. 9 is an isometric view of an embodiment of a liquid fountain unit.
Figure 10:
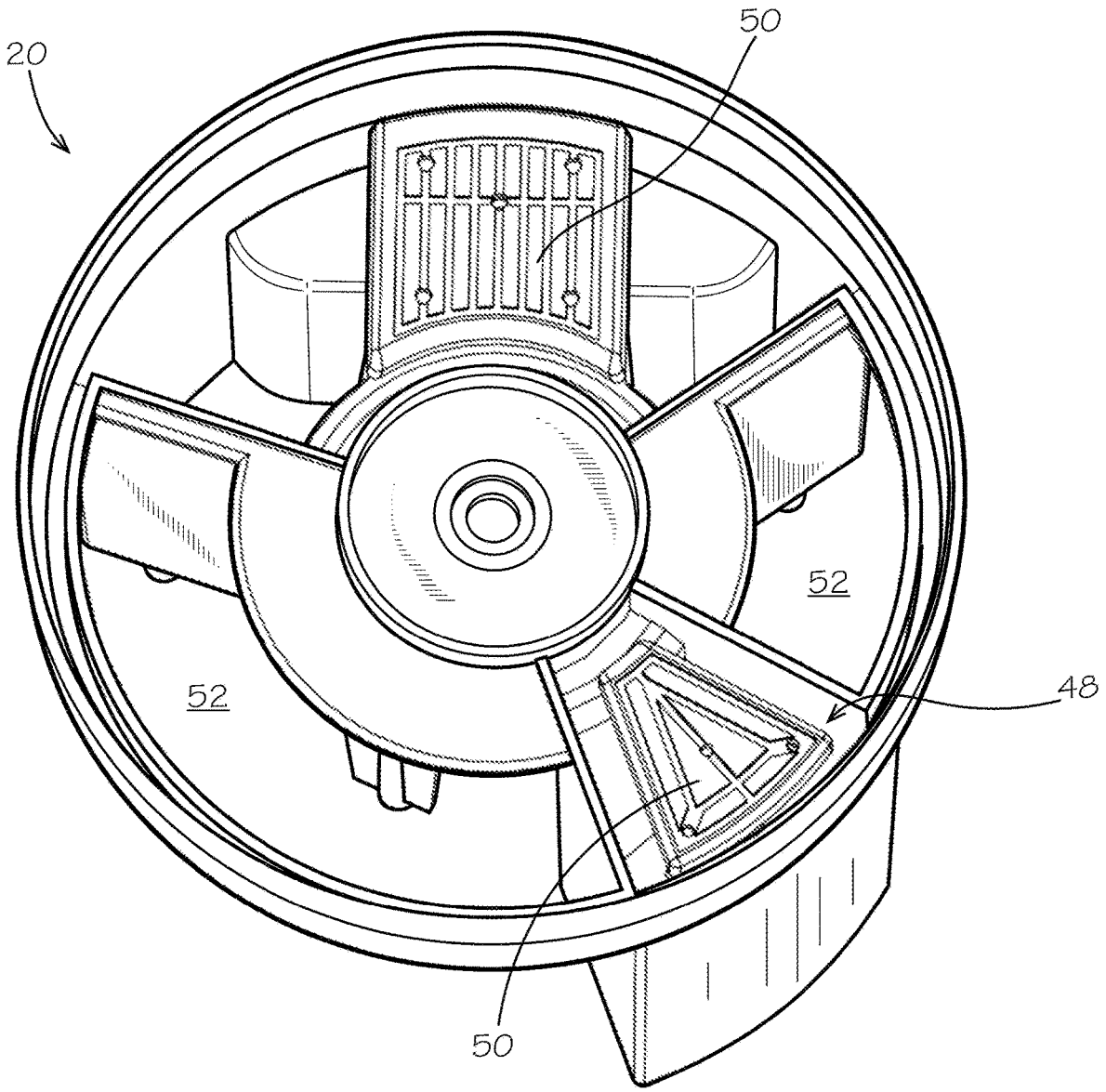
FIG. 10 is an isometric view of another embodiment of a liquid fountain unit.

As shown in detail view of FIG. 9 and in the embodiments contained in FIGS. 3, 4, and 6, liquid fountain unit 20 may comprise a liquid basin 48, a liquid bubbler 50, and an open air section 52. Liquid basin 48 is configured to hold a bubble solution, while liquid bubbler 50 is configured to blow the bubble solution in a generally upward direction 42. Open air section 52 is the portion of the liquid fountain unit 20 that is configured to allow the upwardly blown stream of air 40 produced by fan 18 to pass through and out of the main body top side 46. In some other embodiments, like those illustrated in FIGS. 5, 7, and 10, liquid fountain unit 20 may comprise a plurality of liquid basins 48, a plurality of liquid bubblers 50, and a plurality of open air sections 52. In such embodiments, each of the plurality of liquid basins 48 are configured to hold a bubble solution at separate locations along the liquid fountain unit 20, while each of the plurality of liquid bubblers 50 are configured to blow the bubble solution in a generally upward direction 42 at multiple locations along liquid fountain unit 20. Each of the plurality of open air sections 52 are also configured to allow the upwardly blown stream of air 40 from fan 18 to pass through multiple locations along liquid fountain unit 20. In some embodiments, each of the plurality of liquid basins 48 are differently sized.

Now, the exemplary operation of bubble blower apparatus 100 will be described in detail. The production and dispersion of fully formed bubble by and from bubble blower apparatus 100 begins by the activation of motor 16. Once motor 16 has been activated, fan 18 begins its rotation about rotational axis 24 and production of upwardly blown air 40, liquid fountain unit 20 begins dispersion of upwardly blown bubble solution 42, and gear shaft 22 begins its rotation about rotational axis 24. As the gear shaft 22 continuously rotates about axis 24, so too do bubble wands 26 rigidly affixed thereon. As bubble wands 26 continuously rotate about the rotational axis 24, the bubble wand hoop members 30 repetitively cycle between: (1) passing over the liquid bubbler(s) 50 of the liquid fountain unit 20 and amassing upwardly blown bubble solution 42, and (2) passing over the open air section(s) 52 of the liquid fountain unit 20, such that the upwardly blown air 40 from fan 18 directly contacts the upwardly blown bubble solution 42 amassed on hoop member 30 and forms a bubble that exits from the main body top side 46. In this manner, a continuous stream of bubbles is produced by the bubble blowing apparatus 100 when the motor 16 is activated. Further, excessive bubble solution collected on the hoop members 30 can drip off of the bubble wand 26 and into the liquid basin 48 of the liquid fountain unit 20 to be recirculated by the liquid bubbler 50, rather than falling on the ground and going to waste. In some embodiments, the bubble wands 26 spend a greater percentage of time in contact with the upwardly blown air 40 from fan 18 than in contact with the upwardly blown liquid 42 from the liquid bubbler(s) 50 of liquid fountain unit 20.

Figure 11:
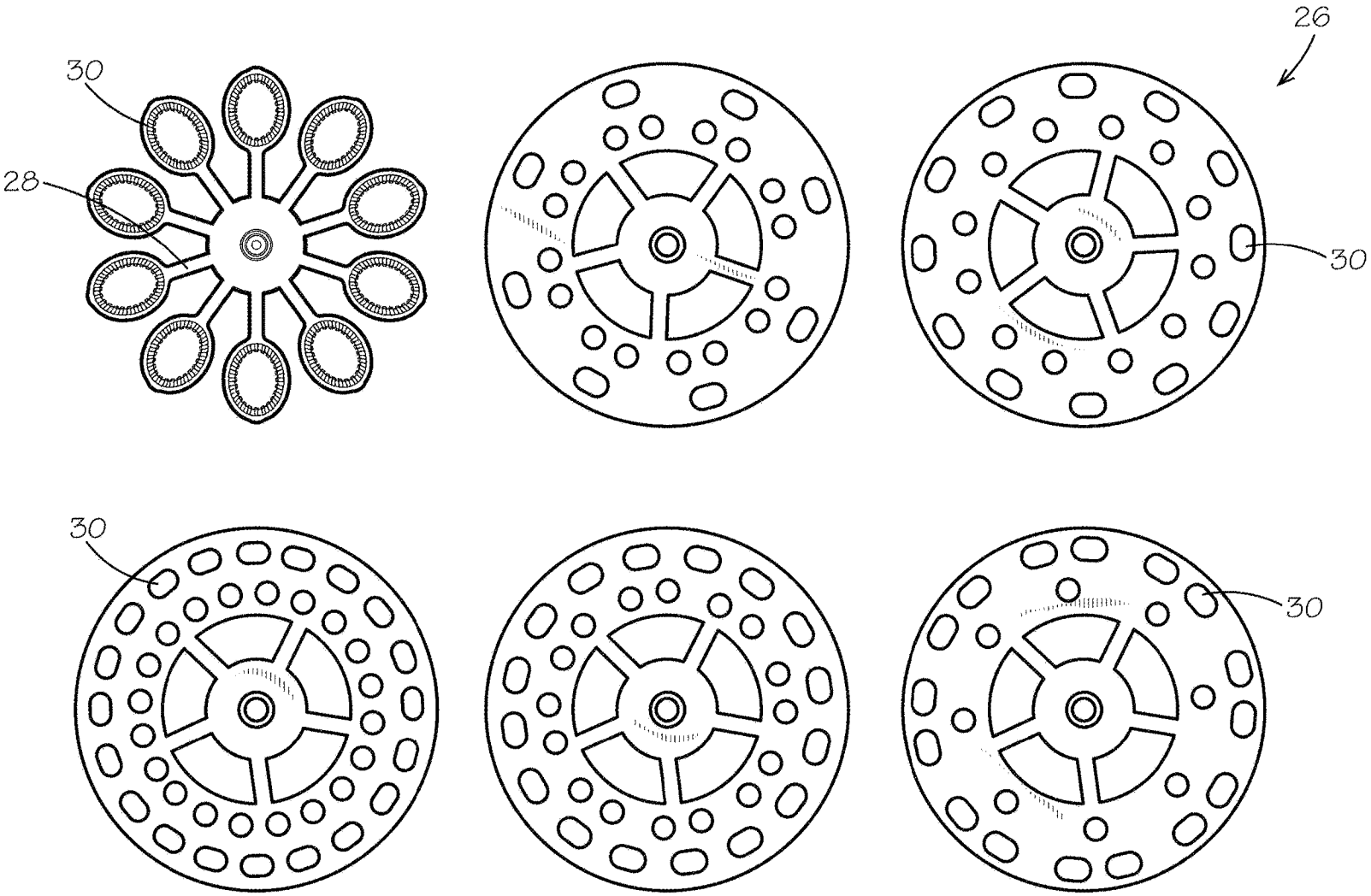
FIG. 11 is a perspective view of particular embodiments of a bubble wand member.
Figure 12:
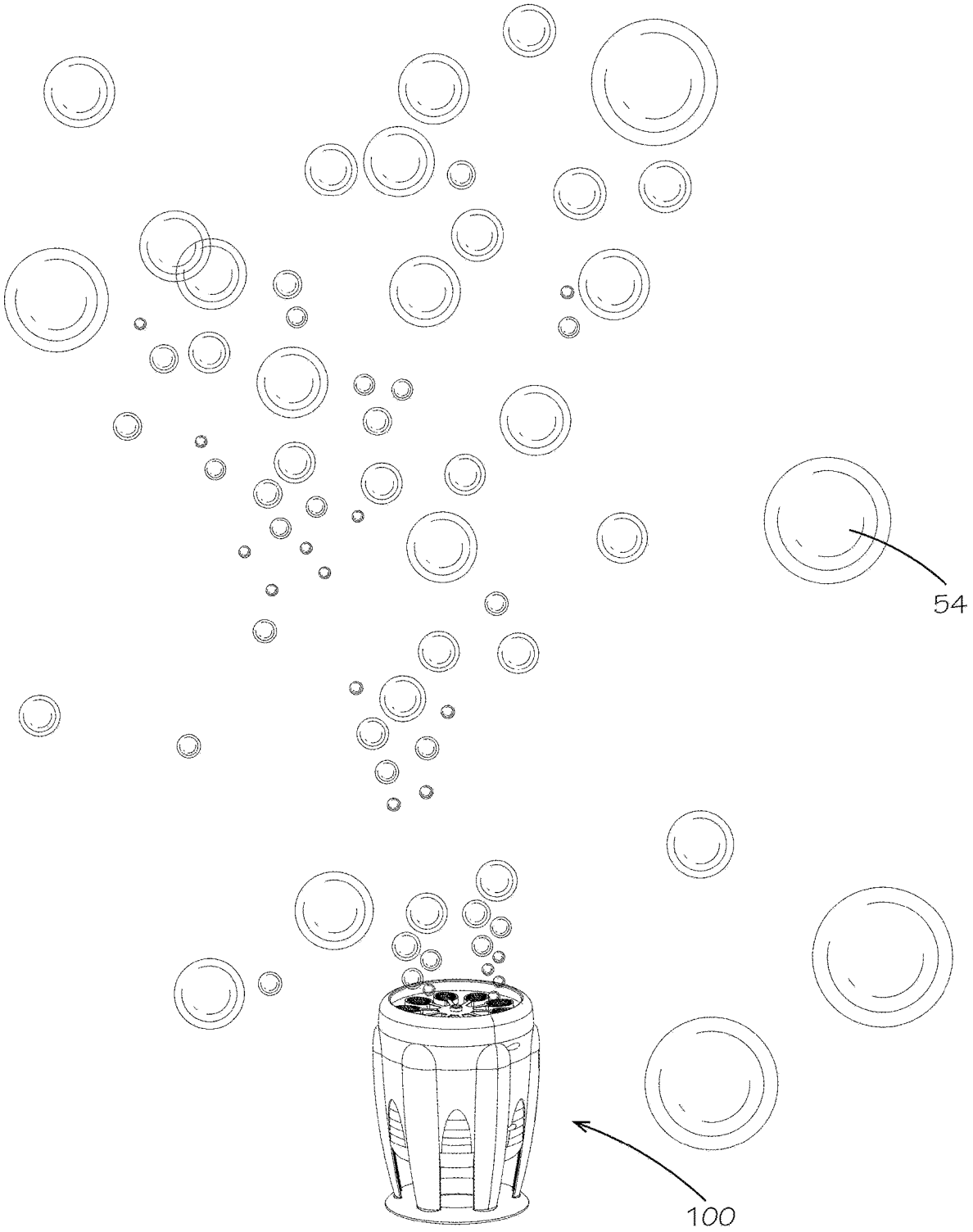
FIG. 12 is a perspective view of an embodiment of a bubble blowing machine blowing small discrete bubbles.
Figure 13:
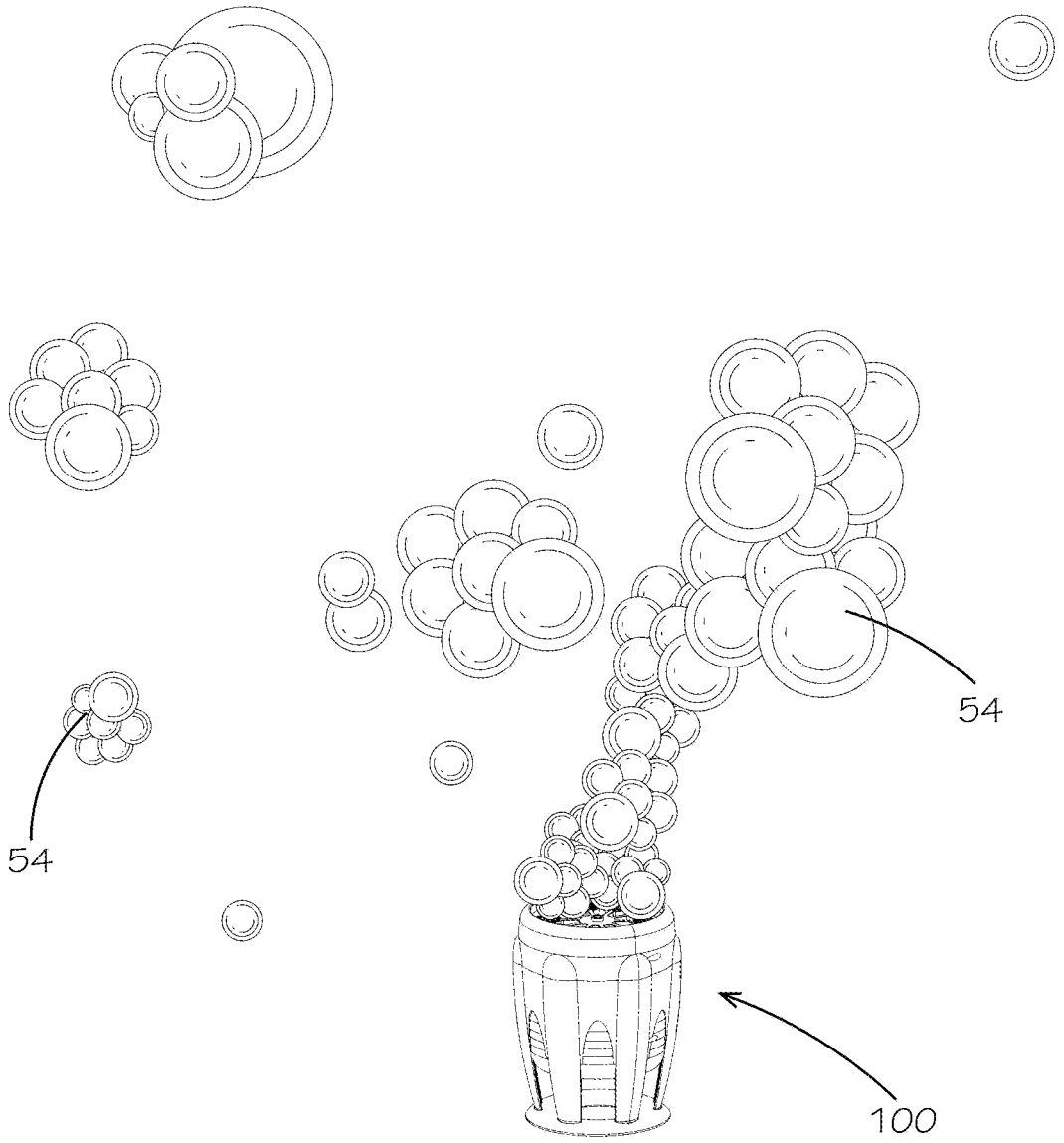
FIG. 13 is a perspective view of an embodiment of a bubble blowing machine blowing larger bubbles grouped together.

As can be seen in FIG. 11, there are many different possible embodiments of the bubble wand member 26, each capable of producing different size or types of bubbles. In some embodiments, bubble wands 26 are interchangeable, allowing the consumer to change the bubble wand depending on the size and type of bubble they want the bubble blower machine 100 to produce. For example, in an embodiment like the one depicted in FIG. 12, operating bubble blower apparatus 100 with one type of bubble wand 26 yields the production of smaller discrete bubbles 54. In other embodiments, bubble blower apparatus 100 may be fit with a different type of bubble wand 26 that produces larger discrete bubbles 54. Still in some other embodiments like that depicted in FIG. 13, the usage of a different bubble wand 26 inside the bubble blower apparatus 100 may yield larger bubbles clusters 54 that become grouped together.

Thus, although there have been described particular embodiments of the present invention of a new and useful BUBBLE BLOWER, it is not intended that such references be construed as limitations upon the scope of this invention.

What is claimed is:

1. A bubble blowing apparatus, comprising:

a housing;

a motor disposed in the housing;

a liquid fountain unit including a first basin shaped to contain liquid bubble solution and a first bubbler configured to eject the liquid bubble solution;

a disc disposed in the housing, the disc including a plurality of openings shaped to receive the liquid bubble solution from the first bubbler, wherein the disc is rotatable relative to the housing and the liquid fountain unit, and wherein the first bubbler is positioned to introduce the liquid bubble solution into a first one of the plurality of openings on the disc as the disc rotates relative to the housing and the liquid fountain unit and when the first one of the plurality of openings is aligned with the first bubbler; and a fan disposed in the housing, the fan positioned to blow a stream of air past the liquid fountain unit and through the plurality of openings on the disc as the disc is rotated relative to the housing and the liquid fountain unit, thereby causing bubbles to be produced from the plurality of openings on the disc, wherein the disc is configured such that each of the plurality of openings on the disc maintain a constant axial position relative to a rotational axis of the disc as the disc rotates relative to the housing and the liquid fountain unit.

2. The apparatus of claim 1, wherein the disc further comprises a plurality of wands extending radially.

3. The apparatus of claim 2, wherein the disc further comprises a plurality of hoop shaped members each disposed on a distal end of a corresponding one of the plurality of wands.

4. The apparatus of claim 3, wherein each of the plurality of openings is defined in a corresponding one of the plurality of hoop shaped members.

5. The apparatus of claim 4, wherein the plurality of wands are integrally formed as a single unit.

6. The apparatus of claim 1, further comprising a second basin disposed on the liquid fountain unit, wherein the second basin is shaped to contain the liquid bubble solution.

7. The apparatus of claim 6, further comprising a second bubbler disposed on the liquid fountain unit, wherein the second bubbler is configured to eject the liquid bubble solution.

8. The apparatus of claim 7, wherein the second bubbler is positioned to introduce the liquid bubble solution into a second one of the plurality of openings on the disc as the disc rotates and when the second one of the plurality of openings is aligned with the second bubbler.

9. The apparatus of claim 6, wherein the first basin is larger in size than the second basin.

10. The apparatus of claim 1, further comprising a gear shaft coupled to the motor and the disc.

11. A bubble blowing apparatus, comprising:

a housing;

a motor disposed in the housing;

a liquid fountain unit disposed in the housing, the liquid fountain unit including a first bubbler configured to eject liquid bubble solution;

a disc disposed in the housing, the disc including a plurality of openings shaped to receive the liquid bubble solution from the first bubbler, wherein the disc is rotatable relative to the housing and the liquid fountain unit, and wherein the first bubbler is positioned to introduce the liquid bubble solution into a first one of the plurality of openings on the disc as the disc rotates relative to the housing and the liquid fountain unit and when the first one of the plurality of openings is aligned with the first bubbler; and a fan disposed in the housing, the fan positioned to blow a stream of air past the liquid fountain unit and through the plurality of openings on the disc as the disc is rotated relative to the housing and the liquid fountain unit, thereby causing bubbles to be produced from the plurality of openings on the disc, wherein the disc is configured such that each of the plurality of openings on the disc maintain a constant axial position relative to a rotational axis of the disk as the disc rotates relative to the housing and the liquid fountain unit.

12. The apparatus of claim 11, wherein the disc further comprises a plurality of wands extending radially.

13. The apparatus of claim 2, wherein the disc further comprises a plurality of hoop shaped members each disposed on a distal end of a corresponding one of the plurality of wands.

14. The apparatus of claim 13, wherein each of the plurality of openings is defined in a corresponding one of the plurality of hoop shaped members.

15. The apparatus of claim 14, wherein the plurality of wands are integrally formed as a single unit.

16. The apparatus of claim 11, further comprising a first basin disposed on the liquid fountain unit, wherein the first basin is shaped to contain the liquid bubble solution.

17. The apparatus of claim 16, further comprising a second basin disposed on the liquid fountain unit, wherein the second basin is shaped to contain the liquid bubble solution.

18. The apparatus of claim 17, further comprising a second bubbler disposed on the liquid fountain unit, wherein the second bubbler is configured to eject the liquid bubble solution.

19. The apparatus of claim 18, herein the second bubbler is positioned to introduce the liquid bubble solution into a second one of the plurality of openings on the disc as the disc rotates and when the second one of the plurality of openings is aligned with the second bubbler.

20. The apparatus of claim 17, wherein the first basin is larger in size than the second basin.

* * * * *